United States Patent [19]

Baiera et al.

[11] Patent Number: 5,031,259

[45] Date of Patent: Jul. 16, 1991

[54] TOILET ODOR ENTRAPPING DEVICE

[76] Inventors: James A. Baiera, 7547 Creekwood Dr., North Royalton, Ohio 44133; Raymond A. Turk, 7448 Old Quarry La., Brecksville, Ohio 44141; James I. Tobias, 902 Hampton Dr., Macedonia, Ohio 44056

[21] Appl. No.: 270,969

[22] Filed: Nov. 14, 1988

[51] Int. Cl.[5] ..... A47K 11/00; E03D 9/00

[52] U.S. Cl. ..... 4/661; 4/300.3

[58] Field of Search ..... 4/300.3, 214, 215, 216, 4/217, 408, 209 R, 347, 348, 349, 352, DIG. 9, 662, 661

[56] References Cited

U.S. PATENT DOCUMENTS

| | | | |
|---|---|---|---|
| 900,831 | 10/1908 | Charlton | 4/214 |
| 1,013,616 | 1/1912 | Rumsey | 4/348 |
| 1,340,567 | 5/1920 | Shadall | 4/216 |
| 1,794,635 | 3/1931 | Mills | 4/217 |
| 2,164,320 | 7/1939 | Groeninger | 4/217 |
| 2,172,506 | 9/1939 | Gerger | 4/217 |
| 2,240,094 | 4/1941 | Foreman | 4/217 |
| 2,685,094 | 8/1954 | MacAillo | 4/216 |
| 3,108,289 | 10/1963 | Smith | 4/217 |
| 3,416,167 | 12/1968 | Klemme | 4/217 |
| 4,103,370 | 8/1978 | Arnold | 4/216 |
| 4,433,441 | 2/1984 | Schroeder | 4/217 |
| 4,709,426 | 12/1987 | Godwin, Jr. | 4/DIG. 5 |

FOREIGN PATENT DOCUMENTS

| | | | |
|---|---|---|---|
| 333666 | 3/1921 | Fed. Rep. of Germany | 4/408 |
| 339381 | 8/1934 | Italy | 4/215 |
| 459329 | 9/1950 | Italy | 4/408 |
| 0808080 | 3/1981 | U.S.S.R. | 4/217 |
| 519531 | 3/1940 | United Kingdom | 4/408 |

*Primary Examiner*—Charles E. Phillips
*Assistant Examiner*—David J. Walczak
*Attorney, Agent, or Firm*—Oldham & Oldham Co.

[57] ABSTRACT

This device produces a water spray in the toilet bowl which acts to entrap toilet odors before they are able to leave the toilet. The water spray is automatically actuated by the weight of the user and is automatically shut off when the users weight is removed. When atached to, or comprising part of a toilet seat, an additional valve, activated by the position of the toilet seat, is utilized.

2 Claims, 2 Drawing Sheets

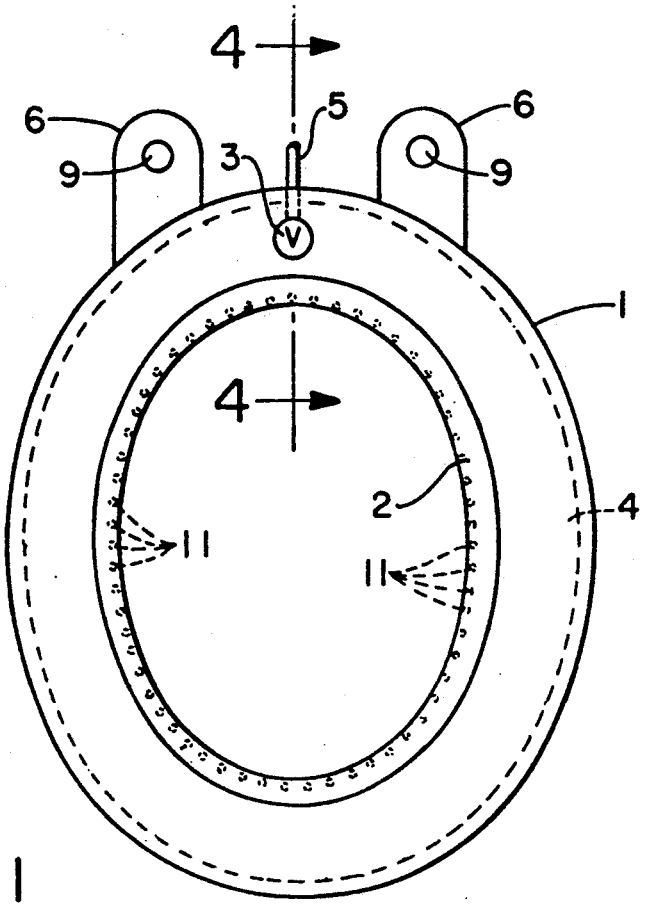
FIG.-1
FIG.-2
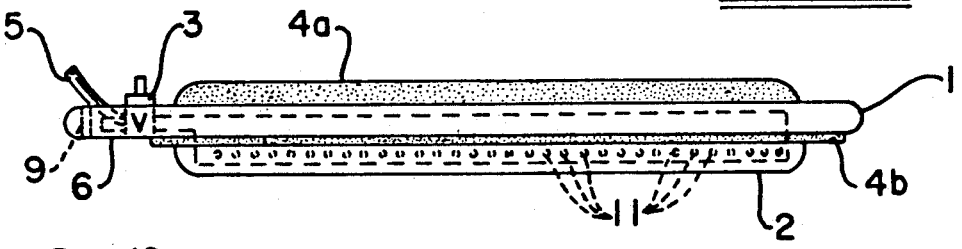
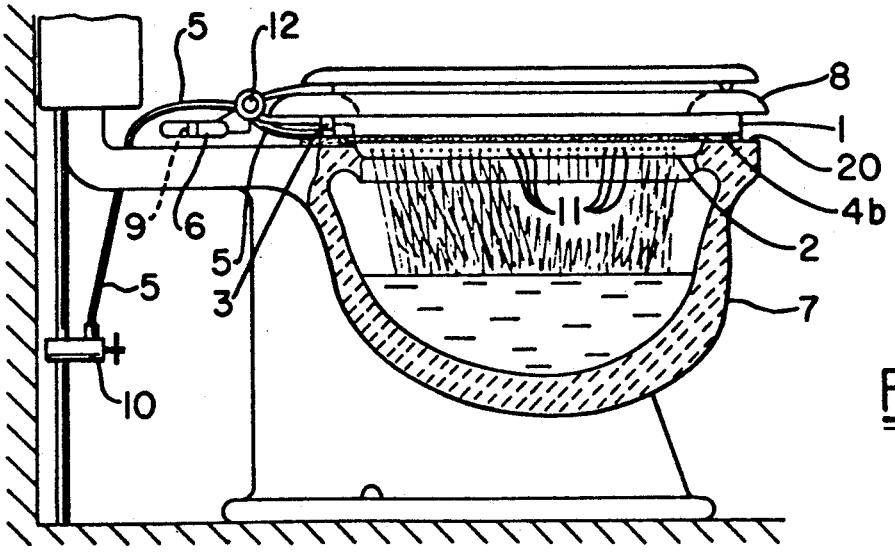
FIG.-3

TOILET ODOR ENTRAPPING DEVICE

SUMMARY

This device, when used with any toilet, provides for the entrapment of toilet odors independent of any additional action by the person using the toilet. The weight of a person sitting on the toilet seat actuates a valve which controls the flow of water to a water channel. When attached to, or comprising part of a toilet seat, the invention also includes a quarter turn valve that is opened by putting the seat "down" in a horizontal position. Water is supplied to this device by flexible tubing connected to any convenient water line. The odor entrapment results from the spraying of water from a large number of small holes in the water channel located around the device.

The water that sprays from the holes in the device is supplied from a water channel that is similar in contour but smaller in diameter than the inner diameter of the rim (20) of a toilet bowl. The perforated water channel can be applied on a frame that attaches to the top of a toilet bowl or as part of, or attached to, a toilet seat. The water spray covers an area above the water normally contained in the conventional toilet bowl. The water spray collides with the odors that exist in the bowl and forces them back down into the water in the bowl.

The toilet odors are ultimately carried away through the toilet drain by the normal flushing of the toilet.

The objects and advantages of the invention will become apparent from a reading of the following detailed description in conjunctions with the drawings wherein:

BRIEF DESCRIPTION OF THE DRAWINGS

FIG. 1 is a plan view of the device showing the location of the weight actuated valve and perforated water channel.

FIG. 2 is a side view of the device showing the seals.

FIG. 3 shows the device attached to a toilet seat.

DESCRIPTION OF THE PREFERRED EMBODIMENTS

Figure 4:
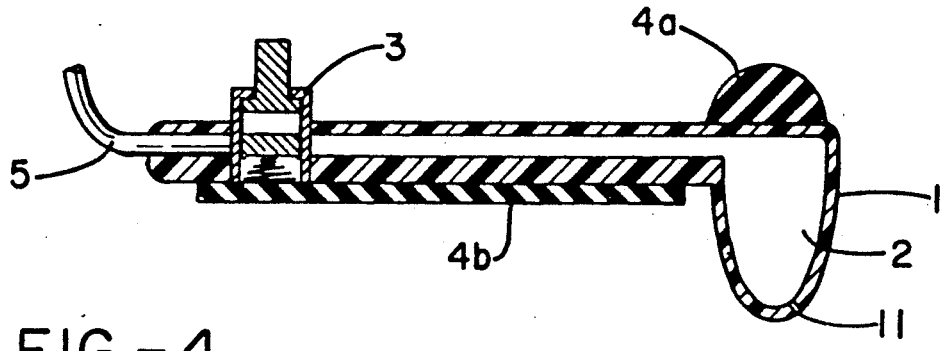
FIG. 4 is a cross sectional view of the device along line A—A of FIG. 1 showing details of the weight actuated valve and perforated water channel.
Figure 5:
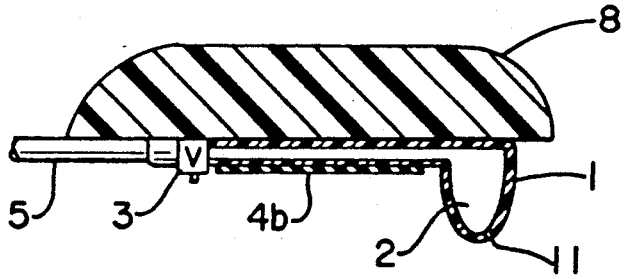
FIG. 5 is a cross sectional view of the device-toilet seat showing the inverted weight actuated valve.

Referring to the drawings, a preferred embodiment of the invention comprises an annular frame (1) which can act to support or form part of a perforated water channel (2), a weight actuated valve (3), one or more annular seals (4), associated water feed lines (5), and attachment means (6).

The device (20) in one embodiment is attached to a toilet (7) as illustrated in FIG. 3, by setting it on the rim of the toilet bowl. The opening of the device is approximately centered over the opening of the toilet bowl and its two attachment holes (9) shown in FIG. 1 are aligned with the holes provided in the toilet assembly to attach a toilet seat. The frame (1), having an outer diameter greater than the inner diameter of the toilet's rim (20) and an inner diameter less than the inner diameter of the toilet's rim, contains a countersunk hole formed into said frame which holds the weight-actuated valve (3) in a recessed position with the valve stem pointing upwardly for actuation.

The weight actuated valve (3) is positioned in the annular frame (1) so that the toilet seat actuates it when a person sits on the toilet seat. Said valve (3) is symmetrically centered in the plane midway between the attachment holes (9) and midway between the outer and inner edges of the frame (1) when viewed from above as in FIG. 1. As shown in FIG. 2 the valve stem protrudes above the plane of the annular seals (4).

The seals (4) shown in FIG. 2 are rings of material having a thickness and positioned to prevent an excessive flow of air between the bottom of the toilet seat (8) and the top of the bowl. One seal is located on the underside of frame (1) and the other on the top side of frame (1).

Attachment of the water feed line (5) to a water source would be most conveniently done anywhere along the toilet tank water feed line with a saddle style valve (10), as illustrated in FIG. 3.

The opening of the weight actuated valve allows water to flow through the water feedline (5) and to the perforated water channel (2). The water channel (2) has an inner and an outer surface wherein the outer surface has an outer diameter slightly less than the inner diameter of the toilet rim and the inner surface has an inner diameter slightly larger than the inner diameter of the frame. One preferred embodiment illustrated in FIG. 4 shows the channel as contained within the frame (1). The number, size, and location of the holes (11) on the inner surface of the perforated water channel (2) allows the water to be discharged into the toilet bowl as shown in FIG. 3 in such a way as to create a water spray from the underside of the device generally angled downward into the open area of the toilet bowl below the rim. This water spraying action entraps the odor emanating from any matter in the toilet.

The water spray continues all the while someone is sitting on the toilet seat (8). It shuts off when the user's weight is removed. An alternate design of the weight actuated valve (3) would provide a damping action while it is shutting off. This, in turn, would, leave water flowing to and through the perforated water channel (2) for a predetermined amount of time.

Figure 6:
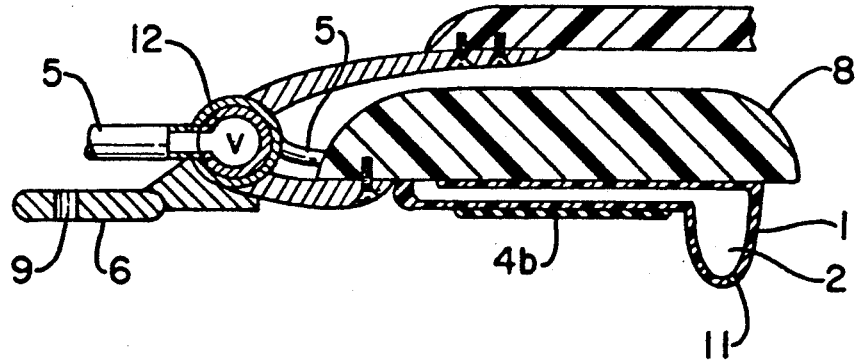
FIG. 6 is a cross sectional view of the device-toilet seat through the quarter turn valve.

The subject device (1) can also be attached to, or made part of, a toilet seat. In this embodiment, an additional one-quarter turn valve (12) illustrated in FIG. 6 is incorporated as part of the toilet seat hinge assembly. This valve (12) acts to prevent the unintentional discharge of water from the water channel (2) while the seat is in its "up" or vertical position, and is so constructed that a path from the water feed line (5) to the perforated water channel (2) is only provided when the seat is "down" and the valve housing and the valve stem is aligned. The weight actuated valve (3) in this embodiment is shown with the valve stem pointed downward so that the valve stem will contact the toilet bowl rim when the appropriate weight is placed on the toilet seat.

It is seen that this invention operates simply and yet provides the useful and beneficial function of eliminating toilet odors through the entrapment action of a water spray emanating from a perforated water channel (2) of the device.

Other embodiments of this invention are the coloring and scenting of the water that is sprayed into the toilet bowl.

These embodiments only are illustrative examples and are meant to be in no way restrictive. Therefore, changes and modifications may be made without departing from the spirit or scope of the invention as defined by the claims that follow.

We claim:

1. A device for use on a toilet capable of entrapping toilet odors wherein the toilet includes a bowl having a rim with an inner and outer diameter on either side of an upper surface, and a seat located above the rim, comprising:

(a) a frame having upper and lower surfaces, and positioned between said seat and said rim, said frame being substantially annular in shape and having an outer diameter greater than the inner diameter of the toilet's rim and an inner diameter less than the inner diameter of the toilet's rim said frame having an upper seal located on the upper surface thereof which contacts said seat and a lower seal located on the lower surface of the frame which contacts said rim;

(b) a means for attaching said frame to the toilet, said frame attached to the toilet in such a way that the opening is approximately centered over the opening of the toilet bowl;

(c) a water channel having inner and outer surfaces and being substantially annular in shape wherein said outer surface has an outer diameter slightly less than the inner diameter of the toilet rim and said inner surface has an inner diameter slightly larger than the inner diameter of the frame, having a means to connect said water channel to the bottom surface of said frame and said water channel having a plurality of perforations on said inner surface;

(d) a water feedline, said water feedline being connected to said water channel at one end;

(e) a means for supplying water under pressure to said water channel by means of said water feedline; wherein water is supplied to the water channel under pressure and is discharged through said plurality of perforations on said inner surface perimeter of said water channel causing a spraying effect directed downwardly and into the open area of said toilet bowl below said rim; and (f) a means for activating said water source when sufficient weight is applied to a horizontally positioned toilet seat, said means for activating said water source is a pressure activated valve positioned in a countersunk hole in the frame, such that the valve stem protrudes from the hole and extends beyond the seal.

2. A device for use on a toilet capable of entrapping toilet odors wherein the toilet includes a bowl having a rim with an inner and outer diameter on either side of an upper surface, and a seat having a lower surface and located above the rim, comprising:

(a) a frame attached to said lower surface of said seat and having a lower surface, said frame being substantially annular in shape and having an outer diameter greater than the inner diameter of the toilet's rim and an inner diameter less than the inner diameter of the toilet's rim, said frame having a seal located on said lower surface which contacts the rim;

(b) a means for attaching said frame to the toilet, said frame attached to the toilet in such a way that the opening is approximately centered over the opening of the toilet bowl;

(c) a water channel having inner and outer surfaces and being substantially annular in shape wherein said outer surface has an outer diameter slightly less than the inner diameter of the toilet rim and said inner surface has an inner diameter slightly larger than the inner diameter of the frame, having means to connect said water channel to the bottom surface of said frame and said water channel having a plurality of perforations on said inner surface;

(d) a water feedline, said water feedline being connected to said water channel at one end;

(e) a means for supplying water under pressure to said water channel by means of said water feedline; wherein water is supplied to the water channel under pressure and is discharged through said plurality of perforations on said inner surface perimeter of said water channel causing a spraying effect directed downwardly and into the open area of said toilet bowl below said rim; and (f) a means for activating said water source when sufficient weight is applied to a horizontally positioned toilet seat, and means for activating said water source is a pressure activated valve positioned in a countersunk hole in the frame, such that the valve stem protrudes from the hole and extends beyond the seal.

* * * * *